United States Patent [19]

Steiner

[11] 4,148,849

[45] Apr. 10, 1979

[54] AIR PURIFYING AND MOISTENING APPARATUS

[76] Inventor: Paul Steiner, Buchenstrasse, CH-9422 Staad, Switzerland

[21] Appl. No.: 782,332

[22] Filed: Mar. 29, 1977

[30] Foreign Application Priority Data

Mar. 29, 1976 [CH] Switzerland ..... 3899/76

[51] Int. Cl.[2] ..... F21V 1/00; B01D 1/14

[52] U.S. Cl. ..... 261/104; 55/385 R

[58] Field of Search ..... 362/96, 101; 261/104, 261/103, 102, 107; 55/385 R, 385 G, 471, 472

[56] References Cited

U.S. PATENT DOCUMENTS

| | | | |
|---|---|---|---|
| 1,213,940 | 1/1917 | Parker et al. | 261/104 |
| 1,533,738 | 4/1925 | Kane et al. | 362/96 |
| 1,824,388 | 9/1931 | Birch | 362/96 |
| 1,890,610 | 12/1932 | Karthaus | 261/104 |
| 2,031,055 | 2/1936 | McKinney | 261/104 |
| 2,611,856 | 9/1952 | Fredin | 362/101 |
| 2,790,510 | 4/1957 | Brabec | 55/472 |
| 2,875,679 | 3/1959 | Humbert | 55/385 R |
| 3,174,688 | 3/1965 | Chatten | 362/96 |
| 3,348,465 | 10/1967 | Kruger | 362/96 |
| 3,457,399 | 7/1969 | Milroy | 55/385 R |
| 3,780,260 | 12/1973 | Elsner | 362/101 |
| 3,890,126 | 6/1975 | Joseph | 55/385 R |
| 3,909,589 | 9/1975 | Stone et al. | 362/96 |
| 3,923,934 | 12/1975 | Watkins | 261/104 |
| 3,937,967 | 2/1976 | Steinitz | 55/472 |
| 4,015,114 | 3/1977 | Paajanen et al. | 55/385 R |

*Primary Examiner*—Frank W. Lutter
*Assistant Examiner*—Gregory N. Clements
*Attorney, Agent, or Firm*—Lackenbach, Lilling & Siegel

[57] ABSTRACT

An air purifying and moistening apparatus having a frame or housing, one or more lamps and at least one absorbent lamp shade. The shade is in communication with a water supply vessel and draws up water by capillary action, which is evaporated from the surface of said lamp shade. The water vessel is detachable and includes a water container or dish with an opening in said water vessel for dripping water into said dish and wetting the lower end of the lamp shade.

20 Claims, 12 Drawing Figures

AIR PURIFYING AND MOISTENING APPARATUS

The invention relates to an air purifying and moistening apparatus having at least one lamp and a lamp shade made of absorbent material which is in communication with a water vessel so as to pick up water by capilliary action and to allow evaporation thereof.

With such a known apparatus the rotation of the lower end of the symmetrically formed lamp shade dips into a supply vessel for water and is connected thereto. The incandescent lamps are located inside the lamp shape. With such apparatus there is the substantial drawback that cleaning and refilling of the supply vessel is practically impossible. For refilling the unit, water must be poured onto the incandescent lamps giving rise to the danger of short circuits, and thus such an apparatus is not practicable.

The invention is therefore directed to an air purifying and moistening apparatus with at least one lamp and a lamp shade made of absorbent material which is simple to use and exhibits long life as well as a satisfactory degree of efficiency.

With an apparatus of the abovementioned type the invention further includes a supply vessel detachably located with an opening on a dish into which the lower end of the lamp shade dips and extracts water by capilliary action over the whole surface of the lamp shade. The lamp shade is preferably zig-zag like for increasing its upper surface and thus is suitably folded. It rises from its lower location preferably widening conically outwardly and the lamp shade also is so designed that it creates a chimney effect. A heating coil is also provided for heating the water. The air is also heated by the lamp. The flow action of the air may be increased by a blower whereby at the same time suitable air guide faces are formed which guide effectively the passage of the air over the lamp shade.

The new apparatus is thus characterised by a high economic value since it moistens the air passing over and a further modification filters any dust out at the same time. Finally it also serves as a lamp.

If the water is to be replenished then the supply vessel only needs to be removed from the dish. It is then filled and again placed on the dish. For a controlled flowing of water from the supply vessel into the dish and from there to the lampshade there are several possibilities. The supply vessel may, for example, be provided at the top and bottom with an opening so that one of these openings is formed as a throttle opening in order that the water only flows slowly. It is preferred however for the opening to be a single opening from the supply vessel and this single opening is furthermore preferably closed by a valve.

There are several embodiments. One embodiment is characterised in that a ball closes from inside the neck of the supply vessel. On the dish is located a pin which, when the supply vessel is placed thereon, lifts the ball from its seating and thereby opens the valve.

Another embodiment of such a valve is characterised in that the valve has a valve body, the upper part of which has influx openings and is arranged in a sealing manner in the supply vessel while its lower part has outlet openings disposed in the dish forming the water distribution system in which a valve stem is located resiliently on the sealing seat of the valve housing. The sealing cone of same is guided in the valve body and a pin is arranged in the water distribution system to adjustably lift the sealing cone when the water vessel is placed thereon.

With these valve constructions, the pressure of the column of water above the valve enables the respective required quantity of water to flow downward through the valve to the water distribution system when the valve is opened. At the same time the respective required quantity of air can flow upwards through the valve into the supply vessel.

The valve used permits a particularly satisfactory dosing of the respective required quantity of water which the air can flow through the lower openings in the valve housing into the supply vessel, and a corresponding quantity of water from the supply vessel passes into the water distribution system.

For a satisfactory sealing it is preferred if the valve body has at least two sealing rings one above the other, the diameter of which is adapted to the inner diameter of the outlet opening of the supply vessel.

A constructional simplification is furthermore achieved in that the influx openings are arranged in a disc of the valve which serves at the same time for supporting the closing spring and guiding of the valve stem.

In addition, the apparatus may be provided with a separately insertable heating means as well as a separately insertable ventilator.

The invention will be described with reference to the accompanying drawings in which.

The lamp has a housing 1 on which is fixed at least one lighting body 2 which is shown in the form of an incandescent bulb. Several such bulbs are preferably arranged along the periphery of the housing 1, and if desired there may be provided a single fluorescent ring or an infra-red lamp. The light fittings 2 are located under a lamp shade 3. This lamp shade extends radially outwardly and is inclined upwardly in order to protect the light fitting from above.

Figure 2:
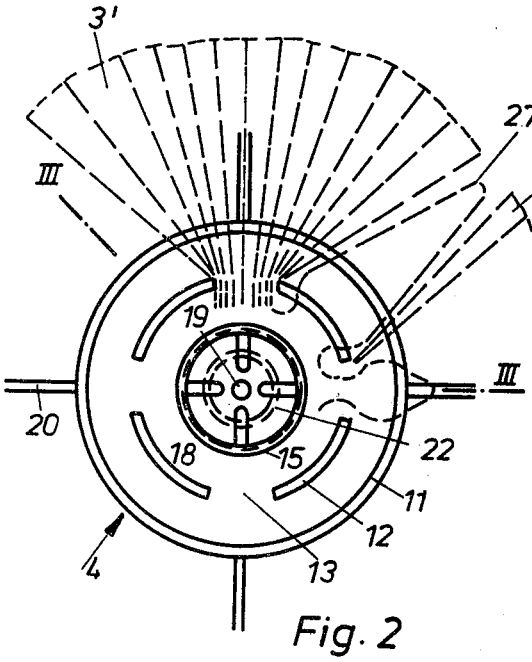
FIG. 2 is a plan view of the water tank.

The shade consists as shown in FIG. 2 of a number of sector like shade parts 3'.

Figure 1:
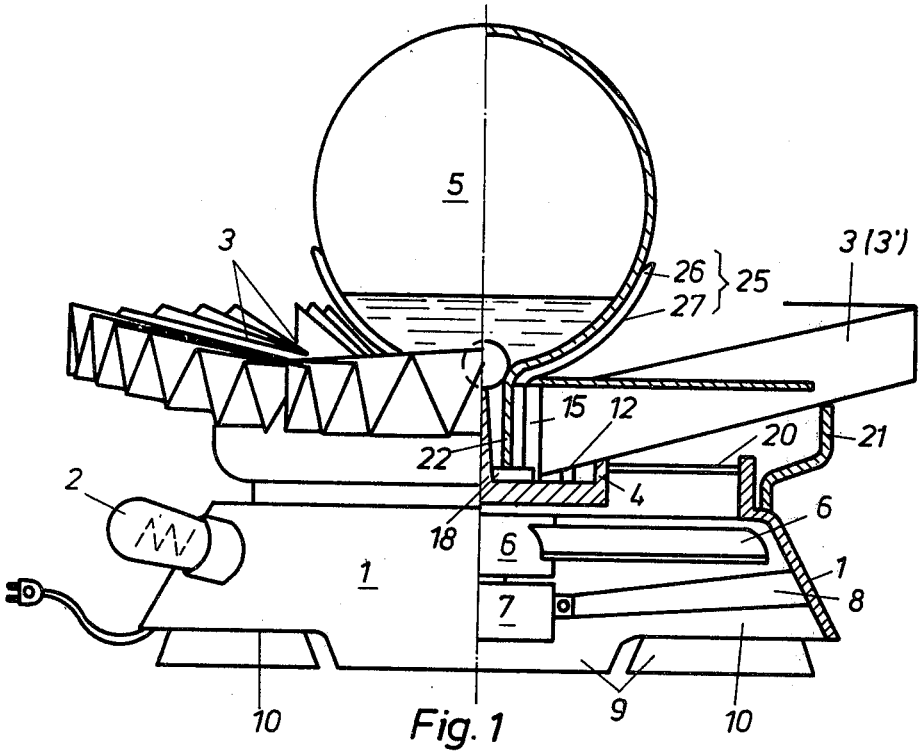
FIG. 1 is a side elevational view of the novel apparatus partly in section.

This lamp shade 3 now serves in addition to its purpose as an element shielding the light but also furthermore serves as an evaporation body of any air moistener disposed inside the housing 1. For this evaporation the lamp shade 3 as shown in FIG. 1, is folded zig-zag so that its evaporation surface is enlarged.

In the embodiment shown, the shade parts 3' are each located with their radially inner edge in a dish-shaped water distribution container 4 which at the same time serves as a support for a water supply vessel 5. The lamp shade 3 and its individual sector-like shade parts 3' draw up water by means of capilliary action from the water container 4. Due to the large surface of the lamp shade considerable evaporation results which is due to the emission of heat from the light fitting or light fittings 2 which reach the underside of the lamp shade. The evaporation may be further increased artificially in that inside the housing 1 a fan 6 with driving motor 7 or a heating ring may be provided. Such elements may be fixed to a strut 8 on the housing 1. The fan 6 sucks air from the underside of the housing which for this purpose is provided with feet 9 which are formed out of the housing 1 and are integral therewith. The spaces between the feet serve as air passage openings 10.

The water container 4 serves at the same time as a support for the water supply vessel 5 as well as an inner bearing for the lamp shade 3 and its individual parts 3'. It has an outer rim 11, a number of central ring elements 12, which are separated from one another by passages 13 as well as a central base 14 which is bounded by a number of ring segments 15. A ball valve 23 is located inside the vessel 5.

Figure 3:
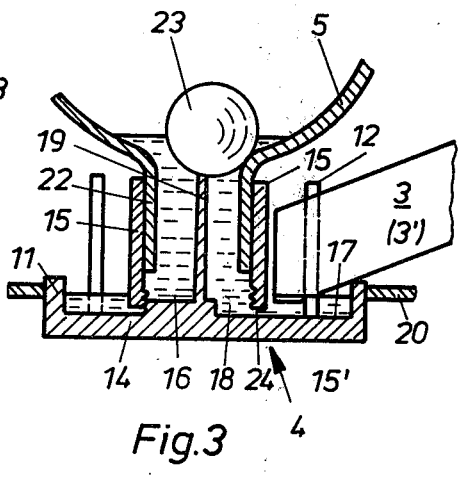
FIG. 3 is a sectional view taken along line III—III of FIG. 2.

In operation, the full water supply vessel 5 with its neck 22 is inserted wrong side up between the ring segments 15. Since the ball valve 23 has a diameter which is greater than that of the neck 22, it closes off the neck. No water can flow out until just before the neck 22 reaches the bottom 16 of the base 14. The ball 23 sits on the needle 19 in the inside of the neck 22. In the last phase of the placing of the vessel 5 this needle 19 now lifts off the ball valve so that water can flow laterally past the ball (FIG. 3). This water flows through the neck 22, the channels 18 and the passages 13 on the bottom 17 of the water container 4. It cannot, however, flow over the rim 11 since after a short time the water level rises such that the water distribution system 18 is filled and also the lower edge 24 of the neck 22, which is somewhat lower than the rim 11 of the water container 4. Thus, no more air as a replacement for the water flowing out can penetrate into the supply vessel 5 and the atmospheric pressure acting on the water level in the container 4 balances the static pressure of the water in the vessel 5 so that no water can flow out any longer.

The water which has flowed out into the water container 4 is now drawn up by the lamp shade 3 by capilliary action. Thus, the water level in the water distribution system 18 drops again so far that air can enter under the edge 21 of the neck 22 into the supply vessel 5. Further water can now escape until the water level rises and again closes the passage. Because of the surface tension of the water, the air does not enter continuously, but only from time to time, into the vessel 5 and rises in the form of air bubbles on the surface of the water. The water level in the water container 4 fluctuates therefore continuously between the upper and a lower level. It can be seen that this fluctuation is independent of the water level in the supply vessel 5 and depends only in the evaporation rate.

Experiments have shown that due to this uniform supply of water and the large surface of the lamp shade 3 which can be freely aerated by the air in the room the evaporation and thus the moistening of the room air takes place and is of considerable value. The operation can be increased artificially by switching on the fan 6, so that the circulating air spreads over the underside of the lamp shade 3 or over the light fittings 2 mounted outside the housing 1 and picks up heat therefrom. The shape and arrangement of the light fittings 2 is determined mainly from an aesthetic point of view. The fan 6 and the light fittings are switchable independently of one another.

Figure 4:
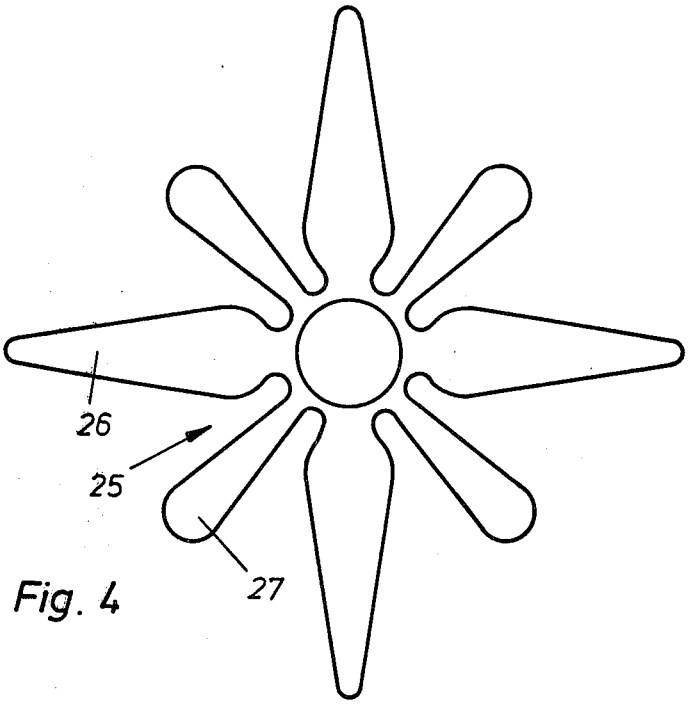
FIG. 4 is a plan view of the air guide plate.

As can be seen mainly from FIG. 2, the individual parts 3' of the lamp shade 3 are inserted in the passage ways 13 between the segments 12. As these passageways are spaced apart from one another there are also spaces between the parts 3'. A portion of the air drawn in by the fan 6, and passing upwards in the water container 4 can escape upwards through these spaces. In order to avoid this an air guide plate 25 is provided, the shape of which can be seen from FIG. 4. It has a number of tongues 26 corresponding to the passageways, which tongues cover the spaces as shown by the dashed or broken lines in FIG. 2 so that this portion of the air is deflected to both sides on the underside of adjacent lamp shade parts 3'.

As this air guide plate 25 is formed from a round sheet metal piece it is expedient to shape and bend the sections 27 lying therebetween so that they support the supply vessel 9 (FIG. 1). This air guide plate 25 is for the sake of clarity only shown in FIG. 1.

Figure 5:
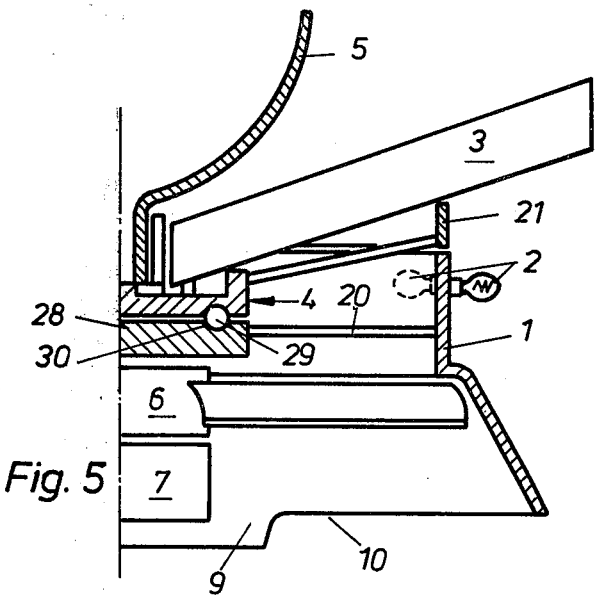
FIG. 5 is a partial sectional view, generally of the right half of FIG. 1 but through an alternate embodiment having a rotatable lamp shade.

A further arrangement for increasing the evaporation is shown in FIG. 5. The struts 20 carry a stationary disc 28 instead of the water container 4. The water container 4 is mounted so as to be freely rotatable on the disc, for example, by means of balls 29 which run in a ball race 30. The supply vessel 5 and the carrier ring 21 also rotate as they are connected to the water container 4. The rotation is effected by the air ascending from the fan 6 which does not ascend upwards exactly perpendicularly but has a movement component in a peripheral direction. This component exercises a pressure on the zig-zag like folded lamp shade 3 which is thus set in rotation and thus also allows the container 4 and the vessel 5 to rotate therewith.

Figure 6:
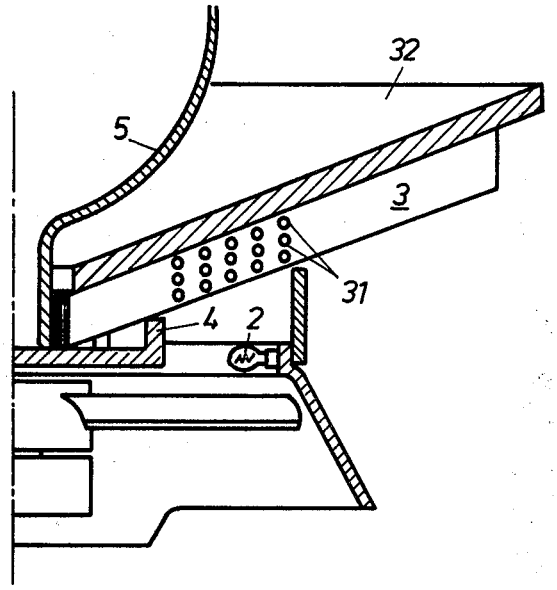
FIG. 6 is another sectional view, through part of another embodiment with ventilation of the upper and lower side of the lamp shade.

In order to guide a portion of the air from the fan 6 onto the upper side of the lamp shade 3 and thus to be able to increase still further the evaporation, the lamp shade 3 may be perforated at least in a part of its area, as is shown in FIG. 6. In order that the air ascending through these holes 31 does not escape freely upwards but passes along the upper side of the lamp shade 3, a further shade 32 may be provided. The shade 32 lies directly on the shade 3 and forms the upper closure of the V-shaped spaces formed by the lamp shade 3.

The light fittings 2, as shown in FIGS. 5 and 6, can also be disposed on the inside of the lamp for example directly below the carrying ring 21 which is then made of transparent material is order to allow the light to pass through. With the rotating construction according to FIG. 5 attractive light effects can thus be obtained.

Figure 7:
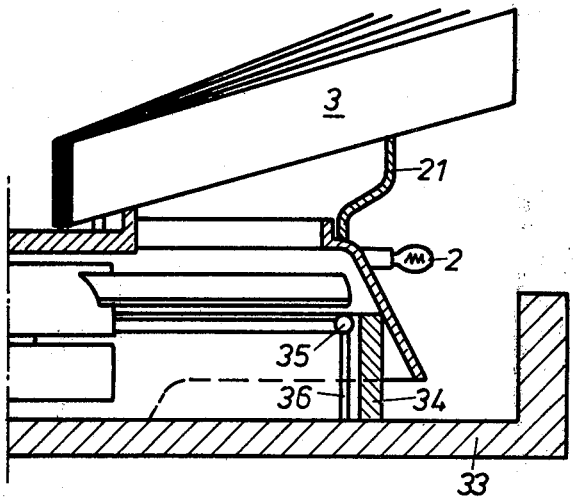
FIG. 7 is a sectional view through part of a lamp with a filtering device for the air.

In the FIG. 7 embodiment where the air is directly sucked in; a portion of the dirt contained in the air remains in the ring filter 34 which therefore must be exchanged from time to time. The ring 34 is placed with its upper edge against the inside of the housing 1 to close passageway openings 10. In order that the upper edge is not pressed inwardly by the suction of the fan, a supporting ring 35 made of wire is provided which is supported from the bottom of the dish 33 by means of rods 36. The filter ring may be of the same material as the lamp shade 3 if it is sufficiently porous and the fan has a sufficient suction action. The dish 33 may also be filled with water so that the air moistening effect may again be increased.

Figure 9:
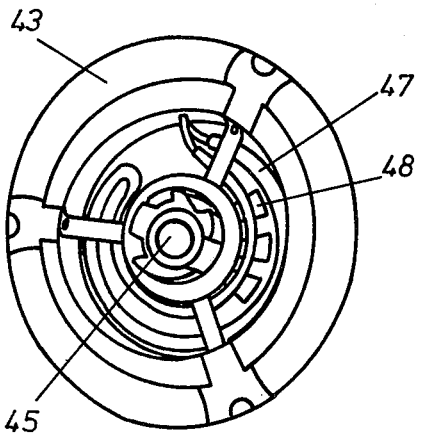
FIG. 9 is a top plan view of the apparatus according to FIG. 8 with the supply container, lamp shade and viewing shield removed to show a light tube and a heating coil with valve seating.
Figure 8:
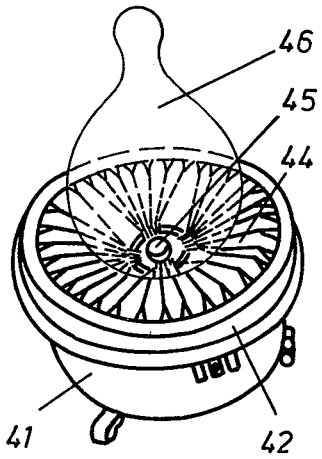
FIG. 8 is a perspective view of a further embodiment of an apparatus according to the invention.

FIG. 8 shows an apparatus according to the invention with a housing 41, on the upper edge of which a covering shade 42 is mounted which extends outwards over a fluorescent tube 43 (see FIG. 9). Inside the housing and on its upper edge a lamp shade 44 of absorbent material is affixed. On the center axis of the apparatus there is located in the center of the lamp shade a valve 45 which will be explained in more detail below with reference to FIG. 12. The valve is located on a distribution system. For further details, reference is also made to the description in the earlier priority patent application, identified as German Specification laid open to public inspection and identified as No. 2,626,657.

Figure 10:
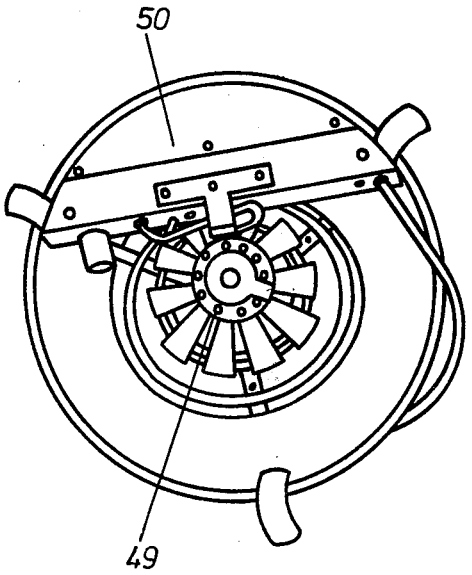
FIG. 10 is a bottom plan view of the apparatus according to FIGS. 8 and 9, showing a blower with air guide chimney for the blower.

On the water distribution system is located a supply container 46 for water which has only one opening. This container may have different shapes. FIG. 8 shows in addition a heating coil 47. In addition vanes 48 of a blower 49 are shown (see also FIG. 10). There is further shown a connection device 50 for operating the fluorescent tube 43.

By means of the arrangement of the fluorescent tube with shade 42, a very conveniently distributed indirect light is obtained which also radiates into the transparent supply vessel 46 and the water present therein. The blower conveys the air from below upwardly through a chimney formed centrally in the housing 41 so that the heated air passes by over the lamp shade 44 which is moistened by the water from the supply vessel 46. Thus, the air is filtered and moistened.

Figure 11:
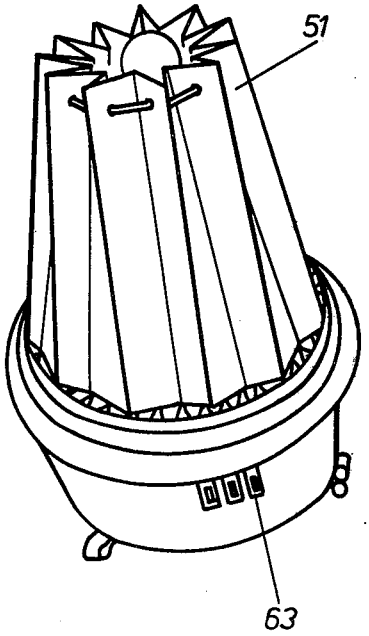
FIG. 11 is a perspective view of the apparatus. According to FIGS. 8–10 with a second lamp shade additionally placed thereon.

FIG. 11 shows one embodiment in which a further lamp shade 51 is placed on the lamp shade 44. In this embodiment the further lamp shade 51 is not made of an absorbent material. It therefore remains dry. It may, however, also consist of an absorbent material. The main advantage of this further lamp shade consists in the lengthening of the chimney so that the blower is superfluous.

Figure 12:
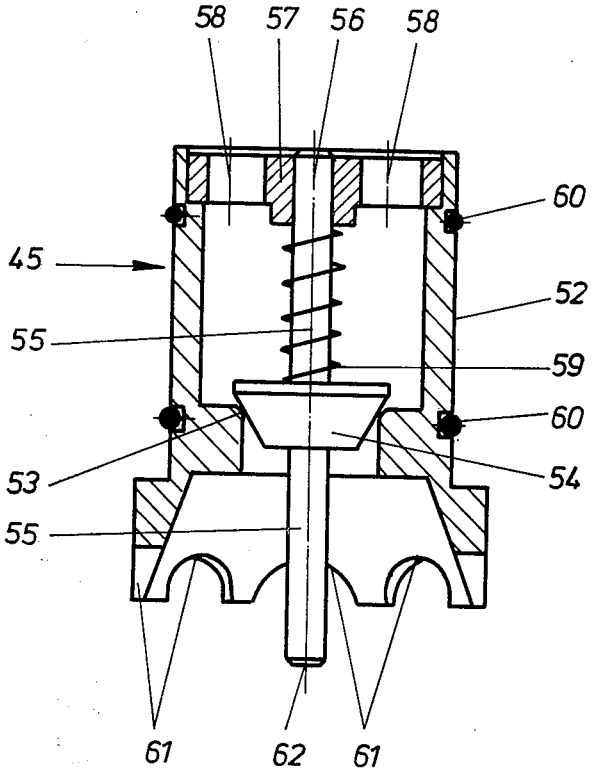
FIG. 12 is a further elevational view, partly in section through another embodiment of a valve.

FIG. 12 shows a central longitudinal section through the valve 45. This consists of a housing 52 in which a valve seat 53 is formed. On this is located a conically formed valve body 54. The valve body is firmly connected to a valve stem 55 which extends from above and below the valve body 54. The valve stem 55 is guided upwards through the bore 56 of a disc 57. The disc has a plurality of holes 58 arranged circularly next to the bore 56 for the passage of air and water. A coiled spring 59 is supported on the valve body 54 and on the underside of the disc 57. It presses the valve body 54 against the seat 53.

On the outside of the housing 52, there are provided two circumferential annular grooves into which sealing rings 60 are inserted. The underside of the housing 52 has a row of arcuately profiled openings 61 in the wall.

With the valve inserted in the apparatus, the valve stem 55 is placed with its lower end 62 on a stop or a pin in the distribution system of the lamp and thus moves the valve body 54 upwardly by a predetermined amount, against the force of the spring 59. Thus, the flow through the valve is released. If the supply vessel 46 is removed then the vessel with the valve inserted in its neck in a sealing manner over the rings 60 is removed so that the valve closes as the spring 59 presses the valve body 54 in a sealing manner against its seat 53.

In operation, the water actually used when the valve is opened is replaced due to the pressure of the column of water in the supply vessel 46. Thus, at the same time air flows through the valve upwardly and in fact to the same extent as the water has to be replaced, it flows through the valve downwardly.

Many modifications of the constructional features described are possible: For example, the heating coil may be dispensed with and/or lamps may be eliminated. The heating coil, lamps and blower which also may be dispensed with are operated by separate switches 63 (see FIG. 11).

I claim:

1. An air purifying and moistening apparatus comprising a frame or housing and at least one lamp and a lamp shade made of absorbent material, said shade being in communication with a water supply vessel (5) for taking up water by capillary action from said vessel and said water being evaporated from said shade, and said supply vessel (5) being detachable and including a water container or dish (4) with an opening (22) in said supply vessel for dripping water into said water container or dish and moistening the lower end.

2. An apparatus according to claim 1, wherein said opening (22) is a single opening of said supply vessel (5) and is closable by a valve (23/45).

3. An apparatus according to claim 2, wherein said valve (45) has a valve body (54), the upper part of which has influx openings (58) and said valve (45) is disposed on a seating in the supply container or vessel (5/46), the lower part having outlet openings (61) disposed in the dish forming the water distribution system with a valve stem (55) located resiliently on a sealing seat (53) of the valve housing (52), the valve body (54) being guided in the sealing seat (53) and having a pin disposed in the water distribution system to adjustably lift the valve body (54) when the water container is placed thereon.

4. An apparatus according to claim 3, wherein said valve (45) has at least two rings (60), one above the other and the diameter of which is adapted to the inner diameter of the opening of the supply vessel (46).

5. An apparatus according to claim 4, wherein said influx openings (58) are disposed in a disc (57) which serves for supporting a closing spring (59) and guiding of the valve stem (55).

6. An apparatus according to claim 1, wherein said lamp shade (3) comprises a plurality of segments.

7. An apparatus according to claim 1, wherein said lamp shade (3) comprises segment parts and said supply vessel (5) are supported by said dish (4) of said apparatus and said dish (4) also serving as an inner bearing for said lamp shade and its segment parts.

8. An apparatus according to claim 1, wherein the outer edge of said lamp shade is higher than that of said dish (4).

9. An apparatus according to claim 1, wherein said opening is an inlet and outlet opening closable by a valve (23) and said dish (4) is provided with a base (14) fixed in the center thereof, the bottom (16) of the base (14) being higher than the bottom of said dish (4) but lower than the rim (11) of the base (14) and having at least one channel (18) which leads from the rim (11) of the base (14) to below the inlet and outlet opening of the supply vessel (5).

10. An apparatus according to claim 9, wherein said valve is a ball (23) which when the vessel (5) is removed closes said inlet and outlet opening, but when the vessel is placed on said base (14) said ball is lifted by a pin (19) carried by said base (14) of said dish (4) or water container.

11. An apparatus according to claim 1, including a fan (6) for drawing air from the underside of said housing (1) through air passage openings (10) in the housing (1) and then causing the air to pass along the underside of the lamp shade or side facing said dish (4).

12. An apparatus according to claim 11, wherein said lamp shade is perforated with holes at least over a part of its surface so that a portion of the air can also pass over the upper side or surface of said lamp shade and that for the purpose of deflecting the portion of the air from the said holes, a further shade (32) is arranged above the lamp shade (3).

13. An apparatus according to claim 12, wherein said further shade (32) consists of absorbent material.

14. An apparatus according to claim 11, wherein said lamp (2) and said fan (6) are disposed in said housing (1) and said housing being stationary; and the lamp shade (3), the water container or dish (4) and the supply vessel (5) are rotatable.

15. An apparatus according to claim 11, wherein said housing (1) is insertable into a further water container (33) provided with a ring (34) made of absorbent material, the upper edge of which contacts against the inside of the housing (1) in order to close the air passage openings (10).

16. An apparatus according to claim 1, wherein said lamp (2) is located inside a transparent housing (21).

17. An apparatus according to claim 1, wherein the outer edge of the lamp shade (3/44) is covered by a second shade (42).

18. An apparatus according to claim 17, wherein said second shade is open at the top and bottom so as to form and lengthen air convection chimney effect for said apparatus.

19. An apparatus according to claim 1, wherein a separately switchable heating element is provided on said housing.

20. An apparatus according to claim 1, wherein a separately switchable fan is provided on said housing.

* * * * *